US008557096B2

(12) United States Patent
Schmidt et al.

(10) Patent No.: US 8,557,096 B2
(45) Date of Patent: Oct. 15, 2013

(54) MULTISTAGE METHOD FOR TREATING METAL SURFACES PRIOR TO DIP PAINTING

(75) Inventors: Andreas Schmidt, Nordheim (DE); Nicole Teubert, Herne (DE); Franz-Adolf Czika, Neuss (DE); Sophie Cornen, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/358,873

(22) Filed: Jan. 26, 2012

(65) Prior Publication Data

US 2012/0186986 A1 Jul. 26, 2012

Related U.S. Application Data

(63) Continuation of application No. PCT/EP2010/060053, filed on Jul. 13, 2010.

(30) Foreign Application Priority Data

Jul. 27, 2009 (DE) ..... 10 2009 028 025

(51) Int. Cl.
*C23F 17/00* (2006.01)
*B05D 1/36* (2006.01)
*C23C 10/02* (2006.01)

(52) U.S. Cl.
USPC ..... 204/487; 427/409; 148/247

(58) Field of Classification Search
USPC ..... 204/487; 427/409; 148/247
See application file for complete search history.

(56) References Cited

U.S. PATENT DOCUMENTS

| | | | | |
|---|---|---|---|---|
| 4,370,177 | A * | 1/1983 | Frelin et al. | 148/247 |
| 5,226,976 | A | 7/1993 | Carlson et al. | |
| 5,401,337 | A | 3/1995 | Carlson et al. | |
| 7,879,158 | B2 * | 2/2011 | Dietsche et al. | 148/275 |
| 2008/0230394 | A1 | 9/2008 | Inbe et al. | |
| 2008/0302448 | A1 | 12/2008 | Frey et al. | |
| 2010/0028541 | A1 | 2/2010 | Nagai et al. | |

FOREIGN PATENT DOCUMENTS

| | | | |
|---|---|---|---|
| WO | WO 2004/081128 | * | 9/2004 |
| WO | 2006088521 A2 | | 8/2006 |

* cited by examiner

*Primary Examiner* — Kishor Mayekar
(74) *Attorney, Agent, or Firm* — Mary K. Cameron

(57) ABSTRACT

The present invention relates to a multistage method for the corrosion-protective and adhesion-promoting treatment of metal surfaces, comprising a first method step for passivating pretreatment using an acidic aqueous composition (A) containing water-soluble compounds of Zr and/or Ti and fluoride ions, a subsequent method step for post-treatment using an aqueous composition (B) containing at least one organic compound having at least one aromatic heterocyclic compound, wherein the aromatic heterocyclic compound has at least one nitrogen atom. The invention further relates to a metal surface treated according to the method according to the invention and the use of said treated metal surface for subsequent coating with an organic binding agent system.

10 Claims, No Drawings

MULTISTAGE METHOD FOR TREATING METAL SURFACES PRIOR TO DIP PAINTING

CROSS-REFERENCE TO RELATED APPLICATIONS

This application is a continuation of International Patent Application No. PCT/EP2010/060053 filed Jul. 13, 2010, which claims priority to German Patent Application No. 10 2009 028 025.1 filed Jul. 27, 2009, both of which are incorporated herein by reference.

BACKGROUND OF THE INVENTION (1) Field of the Invention

The present invention relates to a multi-stage method for corrosion-protective and adhesion-promoting treatment of metal surfaces, encompassing a first method step for passivating pretreatment with an acidic aqueous composition (A) containing water-soluble compounds of Zr and/or Ti as well as fluoride ions, a subsequent method step for post-treatment with an aqueous composition (B) containing at least one organic compound having at least one aromatic heterocycle, the aromatic heterocycle comprising at least one nitrogen atom. The invention further relates to a metal surface treated in accordance with the method according to the present invention, and to the use of said treated metal surface for subsequent coating with an organic binding agent system.

(2) Description of Related Art

WO 2007/065645 discloses aqueous pretreatment solutions for corrosion-protective and adhesion-promoting conversion of metal surfaces prior to a subsequent electrodip coating process, which contain a) no more than 1 mg/l organic polymer having allylamine or vinylamine monomers;
b) at least one further component that is selected from: nitrate ions, copper ions, silver ions, vanadium or vanadate ions, bismuth ions, magnesium ions, zinc ions, manganese ions, cobalt ions, nickel ions, tin ions, buffer systems for the pH range from 2.5 to 5.5, aromatic carboxylic acids having at least two groups that contain donor atoms, or derivatives of such carboxylic acids, silicic acid particles having an average particle size below 1 μm, and
c) a fluoro complex of at least one element M selected from the group B, Si, Ti, Zr, and Hf.

Aqueous compositions of this kind are suitable for corrosion-protective pretreatment, and possess the advantage as compared with conventional phosphating, for example in automobile manufacturing, that they can be used in methods that on the one hand comprise fewer treatment steps and on the other hand, in a context of continuous operation of a pretreatment line, have almost no tendency to form inorganic sludges that, in the case of phosphating, must be laboriously processed because of their heavy-metal content. Phosphating does, however, still possess definite advantages, in terms of adhesion to subsequently applied paint layers and in terms of the corrosion resistance of the crystalline phosphate layer especially on galvanized surfaces, as compared with an amorphous conversion layer based on mixed oxides and hydroxides of the metals Si, Ti, Zr, and Hf.

WO 2008/133047 discloses aqueous treatment solutions for the conversion of metal surfaces, containing fluoro complexes of the metals Ti, Zr, and Hf as well as organic compounds selected from arylamines, aminopolysaccharides, amino-modified phenols, and derivatives thereof, which can additionally contain ions of the elements Mg, Al, Zn, Cu, and Co. WO 2008/133047 further teaches an aqueous post-rinse that contains compounds selected from phosphoric acid, aminophenols, and organic phosphorus compounds. According to the invention, in the course of this post-treatment, specific layer weights in terms of the metallic and organic components on the metal surface are said to be present in a manner implemented for sufficient corrosion protection.

BRIEF SUMMARY OF THE INVENTION

The object of the present invention is now to make available a method for corrosion-protective and adhesion-promoting treatment of a metal surface prior to coating with an organic binding agent system, in which method the adhesion of the subsequently applied and cured organic binding agent system to the metal substrate, and the corrosion protection thereof, is considerably improved with respect to the existing art, such that in a first treatment step, a conversion treatment with an acidic aqueous agent that contains water-soluble compounds of Zr, Ti, and/or Si, and fluoride-ion-releasing water-soluble inorganic fluorine compounds, always occurs.

Surprisingly, it has been possible to considerably improve the paint adhesion and corrosion protection imparted via a conversion treatment of metallic surfaces in a method in which at least the following method steps are carried out successively:

i) optionally, cleaning and degreasing of the metal surface;
ii) passivating pretreatment of the metal surface by bringing it into contact with an acidic aqueous composition (A) containing
   a) water-soluble organic compounds of Zr and/or Ti,
   b) water-soluble inorganic fluorine compounds that release fluoride ions;
iii) post-treating the pretreated metal surface by bringing it into contact with an aqueous composition (B), wherein the aqueous composition (B) in method step iii) contains at least one organic compound having at least one aromatic heterocycle, the aromatic heterocycle comprising at least one nitrogen atom.

DETAILED DESCRIPTION OF THE INVENTION

A "metallic surface" for purposes of the present invention is considered to be surfaces of iron, steel, zinc, galvanized and alloy galvanized iron and steel, which are obtainable e.g. under the commercially usual names Galfan®, Galvalume®, Galvannealed®. Also included among the metallic surfaces that can be treated in corrosion-protective and adhesion-promoting fashion in the method according to the present invention are aluminum, magnesium, and zinc, as well as the respective alloys having a proportion of at least 50 at % aluminum, magnesium, or zinc in the alloy.

The metallic surface treated in the context of the method according to the present invention is by preference a "bare" metal surface. "Bare" metal surfaces are understood as metal surfaces that do not yet carry a corrosion-protective coating. The method according to the present invention is thus by preference the first, or only, treatment step which generates a corrosion-protection layer that can in turn serve the as basis for a subsequent painting operation. It therefore preferably does not refer to a post-treatment of a previously generated corrosion-protection layer such as, for example, a phosphate layer.

Use of the method according to the present invention is particularly advantageous when metallic components made of aluminum are treated, since filiform corrosion as a result of the post-treatment step is considerably reduced.

The corrosion-protective and adhesion-promoting effect of the passivating pretreatment (conversion treatment) and post-treatment can be enhanced in the method according to the present invention by the addition, to composition (A) in step ii), of water-soluble inorganic compounds that release metal ions whose electrochemical standard potential $E^{00}$ ($Me^0/Me^{n+}$) is greater than the electrochemical standard potential of iron $E^{00}$ ($Fe^0/Fe^{2+}$), in particular by the addition to composition (A) in step ii) of water-soluble inorganic metal compounds that release metal ions selected from copper, nickel, cobalt, tin, and/or bismuth.

The electrochemical standard potential $E^{00}$ ($Me^0/Me^{n+}$) of the metal ions $Me^{n+}$ released in composition (A) is that electrochemical potential at which electrochemical equilibrium exists under standard conditions (T=20° C.; ion activity equal to 1) between the metal $Me^0$ in elemental form and its metal cations $Me^{n+}$ in the lowest stable oxidation state. One skilled in the art may gather the corresponding standard potentials from the technical literature, for example M. Pourbaix: "Atlas of Electrochemical Equilibria in Aqueous Solutions," Pergamon, N.Y., 1966.

The positive effect of the post-treatment in step iii) of the method according to the present invention on the paint adhesion and corrosion protection of organic coatings subsequently applied on the metal surface is significant in particular in methods according to the present invention in which composition (A) in the passivating pretreatment solution in step ii) contains water-soluble inorganic compounds that release copper(II) ions.

Use of the preferred method according to the present invention in which composition (A) in step ii) contains water-soluble inorganic metal compounds that release metal ions selected from ions of the elements copper, nickel, cobalt, tin, and/or bismuth, in particular copper(II) ions, is particularly advantageous when metallic composite structures that comprise, in addition to surfaces made of zinc, at least also surfaces made of iron or in particular also at least surfaces made of iron and aluminum, are treated.

It is preferable to use, as an organic compound having at least one aromatic nitrogen heterocycle that is contained in the aqueous composition (B) of the post-treatment in step iii), those heterocycles that are substituted in the α and/or β position with respect to a nitrogen heteroatom of the respective aromatic heterocycle, the substituents in the α position and/or β position being selected from —OR, —NRH, —COOX, —$CH_2$OR, —$CH_2$NRH, —$CH_2$COOX, —$C_2H_4$OR, the residue R being selected in each case from hydrogen, or alkyl or alkylene groups having no more than 4 carbon atoms, and the residue X being selected in each case from hydrogen, alkali metals, or alkyl or alkylene groups having no more than 4 carbon atoms. As a result of this type of substitution, the aromatic heterocycles additionally have a chelating effect on polyvalent metal cations that either are incorporated into the conversion layer and/or passivating layer from the metal substrate as a result of pickling processes, or are contained as such in the pretreatment stage and travel into the post-treatment with the wet film adhering to the substrate.

Preferred aromatic heterocycles in composition (B) of method step iii) are, in the method according to the present invention, selected from triazole, benzotriazole, imidazole, quinoline, and/or indole; quinoline is particularly preferred. A corresponding substitution of this selection of heterocycles in the α and/or β position with respect to a nitrogen heteroatom with the aforesaid substituents is likewise advantageous for the effectiveness of the post-treatment stage iii) in improving the paint adhesion and corrosion protection of subsequently applied organic coatings.

The concentration in the aqueous composition (B) of method step iii) of organic compounds having at least one aromatic heterocycle containing at least one nitrogen atom is by preference at least 10 ppm, particularly preferably at least 100 ppm, but does not exceed 5000 ppm, particularly preferably does not exceed 1000 ppm, calculated as a mass proportion of the aromatic heterocycles containing at least one nitrogen atom in composition (B). The mass proportion of aromatic heterocycles in composition (B) corresponds here exclusively to the mass proportion defined by the aromatic heterocyclic structural unit without substituents. For polymeric water-soluble or water-dispersible organic compounds that comprise heterocycles having at least one nitrogen atom, for example, only the mass-related totality of all aromatic heterocycles having a nitrogen atom in the polymer backbone is relevant.

In the method according to the present invention, chelating complexing agents whose chelate-forming substituents are selected from amino, carboxyl, and/or hydroxyl groups can additionally be contained in composition (B) of the post-treatment in step iii). Suitable chelating agents for purposes of the present invention are, in particular, α-, β- and γ-amino acids.

The chelating agents additionally introduced into composition (B) assist the complexing of polyvalent metal cations of the readily water-soluble metal salts that are contained in the conversion layer and/or passivating layer. The corrosive delamination of subsequently applied organic coatings is further minimized by this action.

The proportion of chelating complexing agents in composition (B) in method step iii) is equal, for this purpose, by preference to at least 10 ppm, particularly preferably at least 50 ppm, but by preference no more than 1000 ppm.

In step i) of the method according to the present invention, the metal surfaces to be treated preferably have oil and grease residues removed from them in a cleaning step. This at the same time generates a reproducible metal surface that ensures a homogeneous layer quality subsequently to the method steps comprising conversion treatment in step ii) and post-treatment in step iii). This cleaning operation is preferably an alkaline one using commercially usual products known to one skilled in the art.

Application of the aqueous compositions (A, B) in method steps ii) and iii) can occur, for example, by immersion into the treatment solution (dip method) or by spraying with the respective composition (spray method). The temperature of the compositions in this context is by preference in the range from 15 to 60° C., in particular in the range from 25 to 50° C. The necessary treatment duration depends on the particular method step and the type of application. In step ii), for example, contact times with the chromium-free composition (A) of at least 30 sec., in particular 1 minute, are preferred. The contact time in step ii) of the method according to the present invention should, however, not exceed preferably 10 minutes, particularly preferably 5 minutes. The contact times with the aqueous compositions (B) in step iii) correspond to those of a usual rinse, and are preferably in the range from a few seconds to minutes.

In the method according to the present invention a rinsing step, particularly preferably with water, in particular with deionized water, can additionally occur before method steps ii) and/or iii).

It is evident that the method according to the present invention is particularly suitable for improving paint adhesion to binding agent systems subsequently applied using a dip method, and cured. Methods according to the present invention are therefore preferably notable for the fact method step iii) is followed, with or without an interposed rinsing and/or drying step, particularly preferably with a rinsing step, especially preferably with a rinsing step but without a drying step, by an electrodip coating operation or an electroless autophoretic dip coating operation.

A "dip coat" refers, according to the present invention, both to those aqueous dispersions of organic polymers that are applied onto the metal surface using the dip method in electroless, i.e. autodeposited fashion, and to those for which coating with the paint from the aqueous phase occurs by application of an external voltage source.

According to the present invention, actions by which the metal surface is dried after contact with compositions (A, B) and before coating with a dip coat, for example a cathodic electrodip coat, are not necessary and in fact are by preference to be avoided. Unintentional drying can, however, occur during a facility downtime when the treated metal surface, for example an automobile body or a part thereof, is in contact with air between the bath having the agent according to the present invention and the dipcoating bath. This unintentional drying is, however, harmless.

The present invention further encompasses a metallic substrate that has been treated in accordance with the method described above, the surface of the metallic substrate having a titanium or zirconium covering of preferably no less than 20 $mg/m^2$ and preferably no more than 150 $mg/m^2$. If composition (A) in step ii) contains metal cations of copper, those metallic substrates in which the covering layer is present with a copper deposition, based on copper, that does not exceed 100 $mg/m^2$, by preference 80 $mg/m^2$, but is at least 10 $mg/m^2$, are preferred.

The use according to the present invention of such metallic substrates in industrial processes for surface finishing by subsequent application of a multi-layer system is encompassed by the present invention.

The metallic materials, components, and composite structures treated in accordance with the underlying invention are furthermore used in the manufacture of preforms, in automotive production for body construction, in shipbuilding, in the building trades, and in the architectural sector, and for the manufacture of household appliances and electronics housings.

Exemplifying Embodiments

The contribution of the method according to the present invention to improving the corrosion protection properties of metal surfaces pretreated with acidic passivating solutions containing fluoro complexes of zirconium is presented below in terms of standardized corrosion tests.

For this, metal panels of cold-rolled steel (CRS), hot dip galvanized steel (HDG), and aluminum (6014 GB) were treated in accordance with the following method steps:

i) Clean and degrease at 55° C. for 5 minutes using an alkaline cleaner of the following composition:
   3.0 wt % Ridoline® 1574A; 0.4 wt % Ridosol® 1270 (Henkel Co.) in tap water
ii) Rinse with tap water
iii) Rinse with deionized water ($\kappa<1\ \mu Scm^{-1}$)
iv) Passivate by treating with a zirconium-based pretreatment solution that has been adjusted to a pH from 4.0 to 5.0 and comprises 750 ppm zirconium, a free fluoride content (using Grano Toner® 38; Henkel Co.) of 100 ppm, and optionally 20 ppm Cu, at 30° C. for 90 seconds
v) Optionally, rinse with an aqueous composition containing 250 ppm of a nitrogen-containing aromatic heterocycle at 30° C. for 90 seconds (post-treatment)
vi) Rinse with deionized water ($\kappa<1\ \mu Scm^{-1}$).

The metal panels treated according to the present invention, and the comparison panels, were dried with compressed air after the last rinsing step and electrodip coated with the following cathodic dip coat: Cathoguard 500 (BASF Co.; cathodic dip coat layer thickness: 20 μm undamaged, determined using commercial layer thickness measuring instrument). The paint was then heated at 175° C. for 25 minutes in an oven.

The treatment of the panels is in accordance with the present invention when the individual method steps i) to vi) are performed successively. A passivating treatment of panels that omits method step v) corresponds to a conventional pretreatment known in the existing art, and therefore serves as a comparison treatment to demonstrate the contribution of the invention.

Table 1 lists the individual experiments with the associated compositions of the pretreatment and post-treatment.

TABLE 1

List of experimental series

| | Pretreatment - Composition (A) | | Post-treatment - Composition (B) | |
|---|---|---|---|---|
| Test | Zr (ppm) | Cu (ppm) | Heterocycle | Quantity (ppm) |
| E1 | 750 | 0 | 8HQ | 250 |
| E2 | 750 | 50 | 8HQ | 250 |
| E3 | 750 | 0 | 8HQ sulfate | 250 |
| E4 | 750 | 50 | 8HQ sulfate | 250 |
| E5 | 750 | 0 | Benzotriazole | 250 |
| E6 | 750 | 50 | Benzotriazole | 250 |
| CE1 | 750 | 0 | none | — |
| CE2 | 750 | 50 | none | — |

8HQ = 8-hydroxyquinoline
8HQ sulfate = 8-hydroxyquinolinium sulfate

On the steel substrate, an improvement in corrosion protection properties was achieved in those methods according to the present invention that omitted the presence of copper(II) ions in the pretreatment (Table 2: compare E1, E3, E5 with CE1). The presence of copper(II) ions in composition (A) of the pretreatment already produces a considerable inhibition in corrosion, so that an additional effect upon exposure of the test panels in the salt spray and alternating climate test cannot be seen over the time period indicated.

TABLE 2

Corrosion tests on treated steel panels (CRS)

| Test | Salt spray test, 1000 h DIN EN ISO 9227 Delamination (mm) | Alternating climate test, 70 days VDA 621-415 Delamination (mm) |
|---|---|---|
| E1 | 1.4 | 1.0 |
| E3 | 1.7 | 1.0 |
| E5 | 1.1 | 1.0 |
| CE1 | 2.3 | 2.0 |
| E2 | 0.8 | 0.9 |
| E4 | 0.8 | 0.9 |
| E6 | 0.8 | 1.0 |
| CE2 | 0.8 | 0.9 |

Corrosive infiltration of the dip coating on hot dip galvanized steel panels treated with copper(II)-containing compositions (A) is considerably reduced by the post-treatment with composition (B) containing aromatic heterocycles having a nitrogen atom (Table 3: compare E2, E4, and E6 with CE2).

TABLE 3

| Corrosion tests on treated hot dip galvanized steel panels (HDG) | |
|---|---|
| Test | Alternating climate test, 70 days VDA 621-415 Delamination (mm) |
| E2 | 3.1 |
| E4 | 3.2 |
| E6 | 2.8 |
| CE2 | 4.1 |

An improvement in corrosion protection also occurs on aluminum panels treated according to the present invention. When copper(II)-containing compositions (A) are used, however, the post-treatment produces a definite improvement only in the filiform test (Table 3: compare E2, E4, E6 with CE2).

It is thus apparent in general that the corrosion-protective treatment according to the present invention is advantageous in particular for parts made of aluminum (Table 3).

TABLE 4

| Corrosion tests on treated aluminum panels (6014 GB) | | |
|---|---|---|
| Test | Filiform test, 42 days DIN EN 3665, average thread length (mm) | CASS test, 10 days DIN EN ISO 9227 CASS, average thread length (mm) |
| E1 | 0.4 | 1.0 |
| E3 | 0.5 | 1.0 |
| E5 | 0.4 | 1.0 |
| CE1 | 2.0 | 2.0 |
| E2 | 2.1 | 0.9 |
| E4 | 2.3 | 0.9 |
| E6 | 0.7 | 1.0 |
| CE2 | 2.8 | 0.9 |

It is likewise apparent that the treatment according to the present invention of composite metal structures that comprise not only zinc surfaces but also iron, or iron and aluminum, surfaces, using copper(II)-containing compositions (A) is preferred, since in this context corrosion on steel is already strongly inhibited in the pretreatment, and the post-treatment with composition (B) then provides inhibition of the zinc surfaces without resulting in any degradation in the corrosion properties of the passivation on the iron surfaces.

The invention claimed is:

1. A method for corrosion-protective treatment of a metal surface, in which method at least the following steps are carried out successively:

i) optionally, cleaning and degreasing the metal surface;

ii) passivating pre-treating the metal surface by bringing it into contact with an acidic aqueous composition (A) containing a) water-soluble organic compounds of Zr and/or Ti, and b) water-soluble inorganic fluorine compounds that release fluoride ions;

iii) post-treating the pretreated metal surface by bringing it into contact with an aqueous composition (B), containing at least one organic compound having at least one aromatic heterocycle, the aromatic heterocycle comprising at least one nitrogen atom and selected from the group consisting of triazole, benzotriazole, imidazole, quinoline, and indole.

2. The method according to claim 1, wherein composition (A) in method step ii) additionally contains water-soluble inorganic metal compounds that release metal cations whose electrochemical standard potential $E^{00}$ ($Me^0/Me^{n+}$) is greater than the electrochemical standard potential of iron $E^{00}$($Fe^0/Fe^{2+}$, in which the metal cations are selected from copper, nickel, cobalt, tin, and/or bismuth.

3. The method according to claim 1, wherein the respective aromatic nitrogen heterocycle of the organic compounds in composition (B) of method step iii) is substituted in the α and/or β position with respect to a nitrogen heteroatom of the respective aromatic heterocycle, substituents in the α position and/or β position being selected from the group consisting of —OR, —NRH, —COOX, —$CH_2$OR, —$CH_2$NRH, —$CH_2$COOX, —$C_2H_4$OR, the residue R being selected in each case from the group consisting of hydrogen and alkyl or alkylene groups having no more than 4 carbon atoms, and the residue X being selected in each case from the group consisting of hydrogen, alkali metals, and alkyl or alkylene groups having no more than 4 carbon atoms.

4. The method according to claim 1, wherein the concentration in the aqueous composition (B) of method step iii) of organic compounds having at least one aromatic nitrogen heterocycle is equal to at least 10ppm, but no more than 5000 ppm, calculated as a mass proportion of the aromatic nitrogen heterocycles in composition (B).

5. The method according to claim 1, wherein composition (B) in method step iii) additionally contains chelating complexing agents, the complexing constant log $K_B$ of the corresponding complex with zinc ions being greater than 10.

6. The method according to claim 5, wherein the chelating complexing agents of composition (B) in method step iii) contain both amine groups and carboxyl groups.

7. The method according to claim 5, wherein the proportion of chelating complexing agents in composition (B) in method step iii) is equal to at least 10 ppm, but no more than 1000 ppm.

8. The method according to claim 1, wherein a rinsing step occurs before method steps ii) and/or iii).

9. The method according to claim 1, wherein method step iii) is followed, with or without an interposed rinsing and/or drying step, by a self-depositing dip coating operation or an electrocoating operation.

10. The method according to claim 2, wherein the metal surface represents a composite structure that, in addition to surfaces made of zinc, at least also comprises surfaces made of iron.

* * * * *